US009222335B2

(12) United States Patent
Caminari et al.

(10) Patent No.: US 9,222,335 B2
(45) Date of Patent: Dec. 29, 2015

(54) CONTROLLABLY RELEASABLE SHIFTING TOOL

(75) Inventors: Richard T. Caminari, Rosharon, TX (US); Grigory L. Arauz, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 684 days.

(21) Appl. No.: 13/431,709

(22) Filed: Mar. 27, 2012

(65) Prior Publication Data

US 2012/0312555 A1 Dec. 13, 2012

Related U.S. Application Data

(60) Provisional application No. 61/495,711, filed on Jun. 10, 2011.

(51) Int. Cl.
*E21B 34/14* (2006.01)
*E21B 23/00* (2006.01)

(52) U.S. Cl.
CPC ..... *E21B 34/14* (2013.01); *E21B 23/00* (2013.01)

(58) Field of Classification Search
CPC ..... E21B 23/00; E21B 23/04; E21B 34/14; E21B 41/00
USPC ..... 166/332.3, 334.2, 242.6, 237, 381, 166/242.7, 377
See application file for complete search history.

(56) References Cited

U.S. PATENT DOCUMENTS

| | | | | |
|---|---|---|---|---|
| 5,156,210 | A | 10/1992 | Roth | |
| 5,183,114 | A | 2/1993 | Mashaw | |
| 5,305,833 | A | 4/1994 | Collins | |
| 5,984,006 | A | 11/1999 | Read et al. | |
| 6,349,767 | B2 * | 2/2002 | Gissler | 166/242.6 |
| 6,978,842 | B2 | 12/2005 | Read, Jr. et al. | |
| 7,347,289 | B2 * | 3/2008 | Lee | 175/317 |
| 2002/0033281 | A1 * | 3/2002 | Aumann et al. | 175/244 |
| 2004/0079531 | A1 * | 4/2004 | Smith et al. | 166/373 |
| 2004/0094310 | A1 | 5/2004 | Read | |
| 2006/0090900 | A1 * | 5/2006 | Mullen et al. | 166/376 |
| 2006/0260818 | A1 * | 11/2006 | Meijer et al. | 166/380 |
| 2009/0065213 | A1 * | 3/2009 | Burnett | 166/319 |
| 2009/0255664 | A1 * | 10/2009 | Hart et al. | 166/117.6 |
| 2010/0108323 | A1 | 5/2010 | Wilkin | |

* cited by examiner

*Primary Examiner* — Kenneth L Thompson
*Assistant Examiner* — David Carroll
(74) *Attorney, Agent, or Firm* — David J. Groesbeck

(57) ABSTRACT

A shifting tool having a release mechanism of predictable deforming radial character. The tool may be utilized for activating any of a variety of different types of downhole actuators. Once more, due to the controlled and predictable manner of deformation employed in the release mechanism, load pulls directed at the actuator may be significant without undue concern over unintended or uncontrolled tool breakage. So, for example, a stuck actuator arm engaged with the shifting tool may be safely pulled at substantially greater loads thereby increasing the odds of dislodging. Thus, the occurrences of added follow-on interventional applications addressing stuck actuator arms may be reduced, resulting in tremendous time and cost savings.

20 Claims, 7 Drawing Sheets

CONTROLLABLY RELEASABLE SHIFTING TOOL

PRIORITY CLAIM/CROSS REFERENCE TO RELATED APPLICATION(S)

This Patent Document claims priority under 35 U.S.C. §119 to U.S. Provisional App. Ser. No. 61/495,711, filed on Jun. 10, 2011, and entitled, "Collet Based Shifting Tool", incorporated herein by reference in its entirety.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. By the same token, offshore wells along with those of ever increasing depths and sophisticated architecture have emerged. Thus, added levels of complexity in terms of completions and maintenance have become fairly commonplace.

In terms of basic architecture, the terminal end of a cased well often extends into an open-hole lateral leg section. Such architecture may enhance access to the reservoir. At the same time, however, this basic architecture presents certain challenges when it comes to their completions and maintenance. For example, a variety of hardware may be installed near and above the lateral leg before production through the leg is commenced. Additionally, perforating, fracturing, gravel packing and a host of other applications may be directed at the leg in advance of production.

In order to carry out the different completions tasks, a formation isolation valve may be present at the juncture between the noted leg and cased regions thereabove. This valve may help to ensure a separation between completion and production fluids. More specifically, comparatively heavier fluids utilized during completions may be prone to adversely affect the formation if allowed to freely flow to the production region of the leg. By the same token, production of lighter high pressure fluids into the main bore during hardware installations may adversely affect such operations. By way of a more specific example, the leg may be outfitted with a formation isolation valve that is opened for gravel packing and other early stage leg applications. However, such a valve may be subsequently closed to isolate the open-hole portion of the leg as other completions tasks are carried out uphole of the leg.

As indicated, closing the valve may avoid fluid loss during completions operations and also maintain well control in the sense of avoiding premature production of well fluids. This closure may be achieved in conjunction with removal of application tools from the open-hole region of the leg. So, for example, following a gravel packing application in a lateral leg, a shifting device incorporated into the gravel packing wash pipe may be used to close off the valve as the assembly is removed from the area. Thus, completion of the application and retrieval of the tool involved may be sufficient to close the formation isolation valve.

Unfortunately, in certain circumstances, the valve may become stuck, thus, preventing retrieval of the tool and assembly as described above. Thus, continued pull on the assembly could potentially result in a breakage that might lead to a host of complications ranging from tool damage to expenses and delays associated with follow-on retrieval operations. Therefore, to avoid such complications, the shifting tool is generally configured with emergency release capacity as noted below.

The valve shifting tool works to shift open the formation isolation valve by interlocking engagement with a matching profile of the valve. More specifically, the tool engages a mandrel of the valve such that upon removal of the assembly, the mandrel is pulled uphole so as to close the valve. However, the engagement portion of the tool is configured for emergency release as noted above for circumstances where the valve has become stuck. So, for example, once a predetermined amount of uphole force has been exerted, and yet the mandrel remains stuck in place, the engagement portion of the tool may deflect out of engagement with the mandrel. More specifically, where 2,000 lbs. to 5,000 lbs. of force has been exceeded without mandrel shifting, the noted deflection will occur and the assembly will be safely removed from the well. In this manner, the tool may be retrieved from the valve and visually assessed at surface for any damage during the emergency release. However, as detailed further below, no such visual inspection or quick remedy is available for assessment and/or repair of the valve which is disposed far downhole.

As indicated, the described deflection and removal of the assembly avoids complications that might otherwise result from a broken tool. Unfortunately, however, this deflection and removal of the assembly still leaves an open formation isolation valve at the junction of the cased and open-hole well regions. Thus, for all intents and purposes the valve fails to achieve its intended use in terms of isolation. Further, as the typical emergency release process is likely to result in damage to the valve, it must be assumed that the valve is damaged such that typical work over remedies (e.g. flushing or circulating fluid to remove debris) will be ineffective in remedying the valve state. As a result, this means that another set of complications is now introduced. Namely, costly delays and expenses associated with the introduction of alternate interventions directed at the valve or new isolation techniques to compensate for valve failure will now likely be introduced.

Once more, even though the tool, in theory, may be constructed of materials capable of withstanding load pull far in excess of 5,000 lbs., deflection is generally set to take place at such relatively low thresholds. This is due to the fact that the engagement between the tool and the mandrel is of a multi-member or 'collet' variety which can result in a substantially uneven distribution of radial forces during the singularly upward pull. Therefore, as a practical matter, lower thresholds are presently required to prevent breakage of any individual collet member where such a deflection technique is employed for the emergency release. Therefore, as a practical matter, lower thresholds are presently required to prevent breakage or significant damage of any individual tool collet member where such a deflection technique is employed for the emergency release. This is particularly the case in light of added concerns over the effect such breakage may have on the valve as well.

SUMMARY

A shifting tool is detailed for releasable engagement with an actuator. The tool includes a collet element with engagement and base portions having substantially greater thicknesses than that of a central region disposed therebetween. Thus, a predictable deformation of the region may ensue upon exposure to a given load. Of course, this summary is provided to introduce a selection of concepts that are further described below and is not intended as an aid in limiting the scope of the claimed subject matter.

DETAILED DESCRIPTION

Embodiments are described with reference to certain downhole assemblies that make use of a valve and valve actuator. In particular, production assemblies that are configured for disposal across cased and open-hole regions at various well locations are detailed. More specifically, subsea completions employing formation isolation valves are depicted. However, embodiments of a controllably releasable shifting tool as detailed herein may be directed at a variety of different actuator types. For example, actuators for triggering different types of valves, sliding sleeves, packer setting tools and other substantially permanent downhole devices may be configured for engagement with a shifting tool as described herein-below. Similarly, the oilfield environment need not be subsea as depicted. Regardless, however, the shilling tool is particularly configured to allow for controlled or 'emergency' release in a predictable and reliable manner heretofore unseen.

Figure 1:
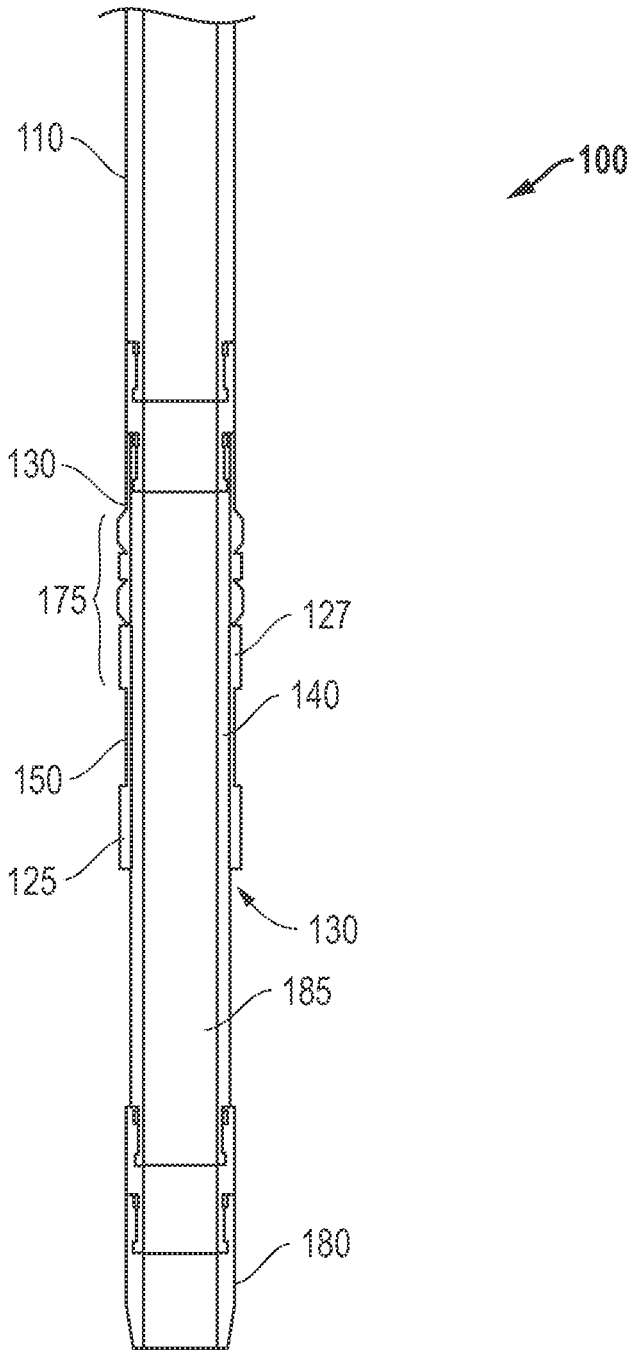
FIG. 1 is a side view of an embodiment of a controllably releasable shifting tool.
Figure 3B:
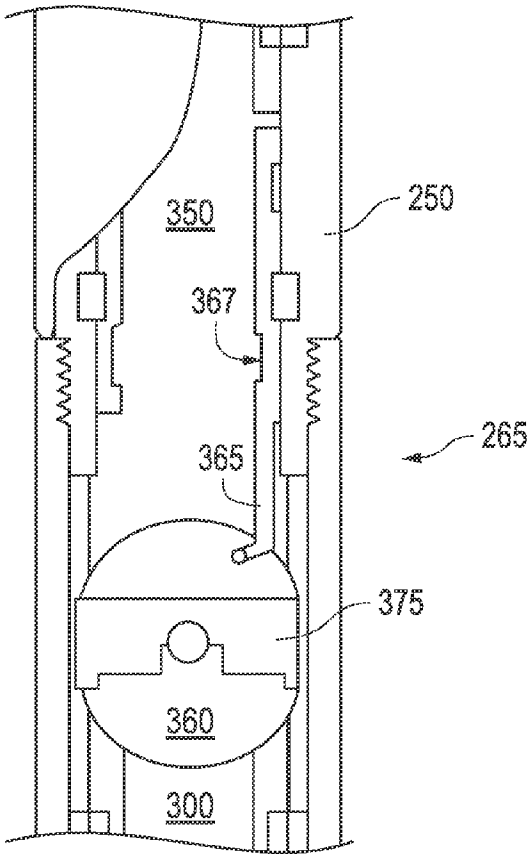
FIG. 3B is a side sectional view of the valve of FIG. 3A upon uphole disengagement and closure by removal of the tool.
Figure 3A:
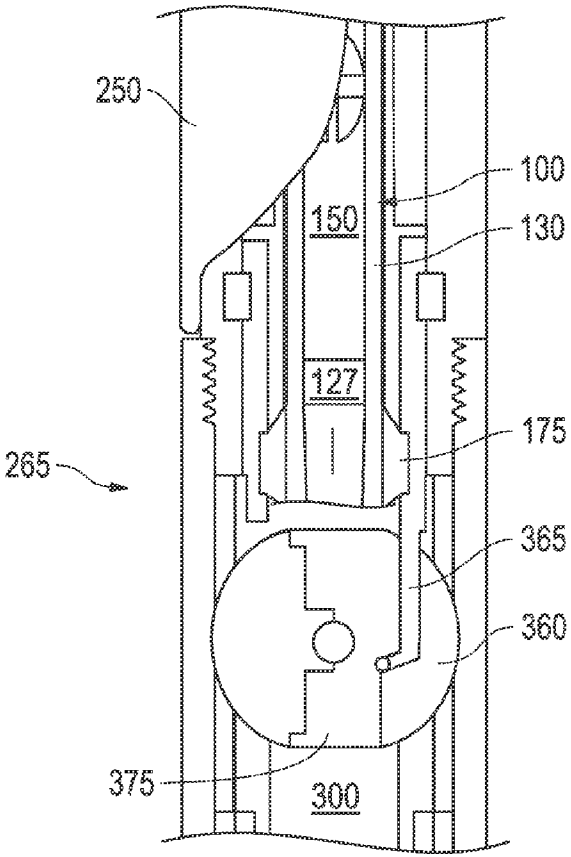
FIG. 3A is a side sectional view of the tool engaged with a valve of the hardware of FIG. 2.

Referring now to FIG. 1, a side view of an embodiment of a controllably releasable shifting tool 100 is shown. The tool 100 includes collet elements 130 which are each outfitted with an engagement portion 175 configured to engage an actuator of a downhole tool, for example to shift a valve 360 closed as shown in FIGS. 3A and 3B. Additionally, each element 130 is also configured to allow for controlled emergency release or disengagement in a predictable manner. So, for example, in certain circumstances the noted valve 360 may be stuck open such that even several thousand pounds of load pull imparted on the tool 100 is insufficient to initiate actuator function (e.g. 2.000 lbs.-5,000 lbs.). Therefore, rather than allow the tool 100 or actuator features to damage or break, a controlled disengagement may be achieved. That is, disengagement may be achieved in a substantially damage-free manner relative each element 130 as well as features of the actuator and valve 360 as detailed below. Thus, future operation of the valve 360 is unlikely to be compromised even upon failure of actuator shifting.

Unlike conventional emergency release techniques, the above noted disengagement of the tool 100 is achieved in a manner of enhanced controllability. More specifically, each collet element 130 is equipped with a discrete central deformable region 150. This region 150 is of a thickness that is substantially below that of the noted engagement portion 175. Similarly its thickness is substantially below that of a base portion 125 which is structurally secured to a delivery tool 110, in this case wash pipe. Thus, the central deformable region 150 is located between portions 125, 175 of substantially greater resistance to deformation upon imparting of a load on the tool 100. Ultimately, this type of distinctiveness of the region 150 may lead to a controlled deformation that provides a predictable release where appropriate.

As to specific potential differences in thickness between the central region 150 and the adjacent base 125 and engagement 175 portions, a wide range of options may be utilized. For example, for most embodiments, the difference in thickness may be anywhere between about 25% to about 90%. More specifically, in one embodiment a difference of between about 40-70% is employed with the deformable region 150 being of between about 75 to 125 thousandths of an inch thick compared to adjacent portions 125, 175 of between about 145-185 thousandths of an inch thick.

Of course, there is no particular requirement that the base 125 and engagement 175 portions be of identical thicknesses on a given collet element 130. However, in certain embodiments, each portion 125, 175 of a given collet element 130 is of substantially similar thickness. Further, to ensure predictability in the noted deformation, each central deformable region 150 of each collet element 130 is substantially similar in thickness. Indeed, by the same token, each base portion 125 of all collet elements 130 is substantially similar in thickness as is each engagement portion 175 relative one another. Once more, while each engagement portion 175 is of a keyed or changing profile, a transition location 127 of the portion 175 is provided which displays a consistency of thickness. Thus, as a matter of measured comparison for a given collet element 130, this location 127 of the engagement portion 175 is of substantially similar thickness to the base portion 125 in the preferred embodiment noted above.

Continuing with reference to FIG. 1, the tool 100 is configured for deployment via a wash pipe delivery tool 110. Such may be provided as part of a larger overall gravel packing or other assembly, depending on the nature and stage of downhole operations. To this end, the overall tool 100 depicted includes a central flow thru channel 185 terminating at a conventional bull nose region 180. However, a variety of different tool configurations may be utilized, generally ranging between about 2-4 inches in diameter. In fact, due to the generally thinner nature of the above detailed central deformable region 150, the diameter of the channel 185 may be at the larger end of the spectrum and the overall length of the tool 100 reduced as compared to conventional shifting tool. For example, in one embodiment, the channel 185 may be over about 3 inches and the length of the tool 100 below about 90 inches, thereby enhancing flow capacity and reducing overall tool weight and size for sake of transport.

Figure 2:
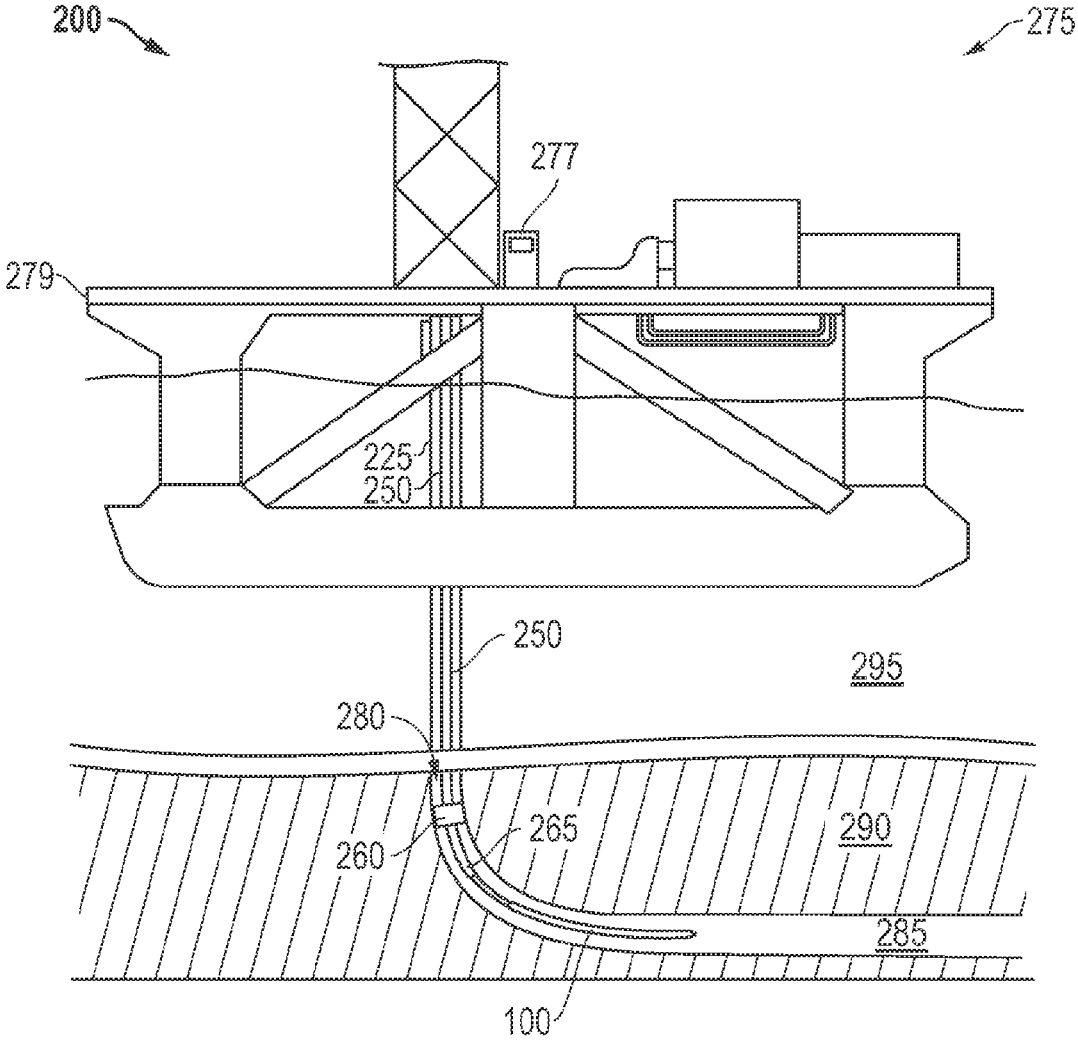
FIG. 2 is a side overview of a subsea oilfield with a riser and well assembly accommodating hardware with the shifting tool of FIG. 1 disposed therein.

Referring now to FIG. 2, with added reference to FIGS. 3A and 3B, a side overview of a subsea oilfield 200 is shown whereat a riser 225 and adjoining well 280 are located. As shown in FIG. 2, hardware 260, 265 of the well 280 is depicted with the shifting tool 100 of FIG. 1 disposed therein. More specifically, the hardware includes a packer 260 for isolating a largely open-hole leg 285 running through a formation 290 along with a valve housing 265 for containing a formation isolation valve 360 as referenced above and detailed further below. Thus, fluid communication as between production tubing 250 within the riser 225 and the interior of the leg 285 may be regulated.

Continuing with added reference to FIGS. 3A and 3B, the valve 360 may be in an open position with the tool 100 disposed through the housing 265 and into the leg 285. As such, applications directed at the leg 285 may proceed. So, for example, an application such as gravel packing may be directed through a control unit 277 and other surface equipment 275 disposed at a rig platform 279. By the same token, however, at the completion of such applications in the leg 285, the shifting tool 100 may be withdrawn back up through the housing 265 and tubing 250. This may be done in a manner that simultaneously closes the valve 360 as described below. As such, other applications, such as the installation of additional hardware above the packer 260, may proceed in a manner that is safely isolated from any production fluid influx from the leg. Similarly, the closed valve 360 may also prevent heavier uphole application fluids from undesirably leaking into the leg 285.

Continuing with reference to FIG. 2, with added reference to FIG. 1, the shifting tool 100 is with collet elements 130 that include a central deformable region 150 of comparatively reduced thickness. Thus, as indicated above, the size of the tool 100 as well as the footprint of associated delivery equipment may be similarly reduced. So, for example, easier transport to the rig floor 279 may result along with added space thereat, both of which may be particularly beneficial in the case of offshore operations as depicted.

Referring now to FIGS. 3A and 3B, side sectional views of the shifting tool 100 are shown disposed within the valve housing 265. More specifically, FIG. 3A reveals the tool 100 engaged with an actuator mandrel 365 for the open formation isolation valve 360. FIG. 3B, on the other hand shows this ball valve 360 in a closed position in conjunction with the upward pull and disengagement of the tool 100 from the mandrel 365.

With specific reference to FIG. 3A, the shifting tool 100 is shown upon initiation of its uphole removal through the valve housing 265 and production tubing 250. Thus, the engagement portion 175 of the tool 100 engages with the actuator mandrel 365 of the formation isolation valve 360. As such, continued upward pull results in an upward shift of the mandrel 365 thereby rotatably closing off the valve passage 375 relative the otherwise open interior 300 of the housing 265 (see FIG. 3B). Thus, the uphole interior 350 of the hardware is now fluidly isolated from the noted housing interior 300. With added reference to FIG. 2, isolation of riser 225, production 250 and other uphole tubular disposed hardware is now achieved relative the leg 285 below the packer 260 and housing 265. Therefore, completions and other uphole applications may proceed in a fluidly isolated manner relative the leg 285 as detailed above.

Additionally, in circumstances where the upward pull on the actuator mandrel 365 is compromised and stuck, the shifting tool 100 is outfitted with collet elements 130 that are configured to avoid pull induced tool breakage. That is, upon exceeding a load pull in excess of a predetermined amount, the tool 100 will ultimately disengage from the mandrel 365 regardless of whether or not a completed valve closure has been achieved. More specifically, in one embodiment, a load in excess of 50,000 lbs. will result in disengagement of the engagement portion 175 relative a recess 367 of the mandrel 365, provided certain sequential movement occurs as detailed further below. Having such substantial loads available without undue concern over damage to the tool 100 and/or mandrel 365 also increases the likelihood that a stuck actuator may be dislodged and unstuck prior to disengagement and release. Further, the substantial load may be applied for longer time than previously possible. That is, the more time spent applying the load, the more time the force is transmitted and propagated through the system. Thus, the likelihood is increased of overcoming obstacles such as debris or corrosion that may impede valve functionality.

With added reference to FIGS. 4A-4D, this release may be achieved through the controlled deformation of the central region 150 of the collet element 130. As such, a reduced diameter (D) of the tool 100 may be achieved so as to allow an emergency release thereof where appropriate (see also FIGS. 5A and 5B). As detailed hereinabove, this controlled deformation of the central region 150 may be a result of substantially thicker base 125, transition 127 and/or engagement 175 portions of each element 130 immediately adjacent the noted region 150. By the same token, however, the central region 150 may also be of sufficient thickness to achieve shifting of the mandrel 365 without any notable deformation in circumstances where no sticking thereof is involved (as depicted in FIG. 3B).

With more specific reference now to FIGS. 4A-4D, cross sectional views of the actuator mandrel 365 being pulled upward (arrow 480) by the engaged collet element 130. More specifically, increasing sequential deforming of the central region 150 of the element 130 is apparent as the load pull progresses. That is, with the actuator mandrel 365 stuck in place and incapable of shifting upward (arrow 480), the pull imparted through the underlying support mandrel 140 is translated into a predictable deformation. Indeed, with added reference to FIG. 1, this deformation may be substantially uniformly displayed throughout each collet element 130 of the tool 100 such that a controlled or 'emergency' disengagement from the stuck mandrel 365 is achieved.

Figure 4D:
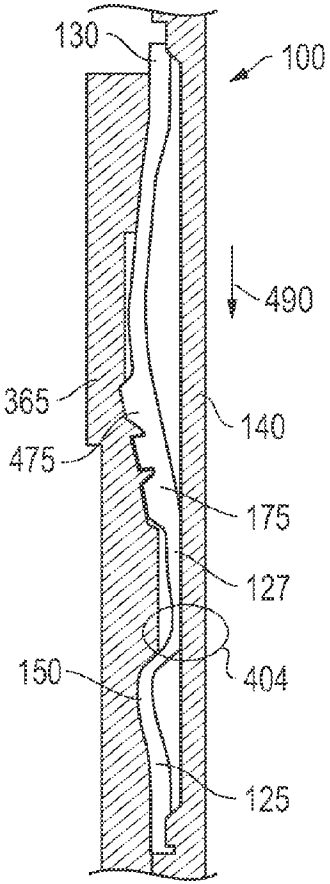
FIGS. 4A-4D are sequential cross sectional views of an actuator mandrel of the valve and a deforming collet element of the tool upon alternate uphole emergency disengagement.
Figure 4C:
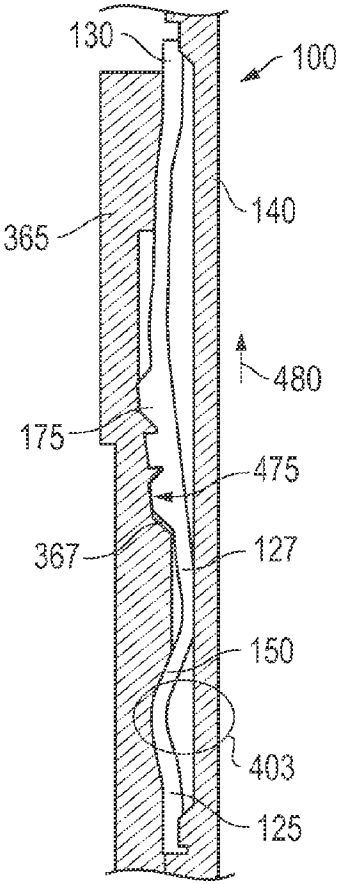
Figure 4B:
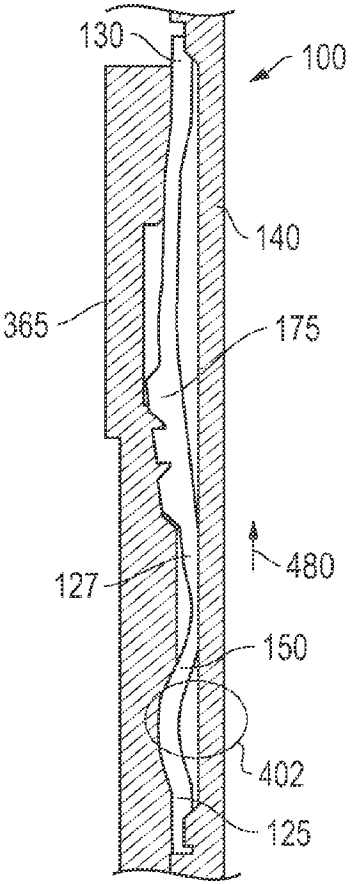
Figure 4A:
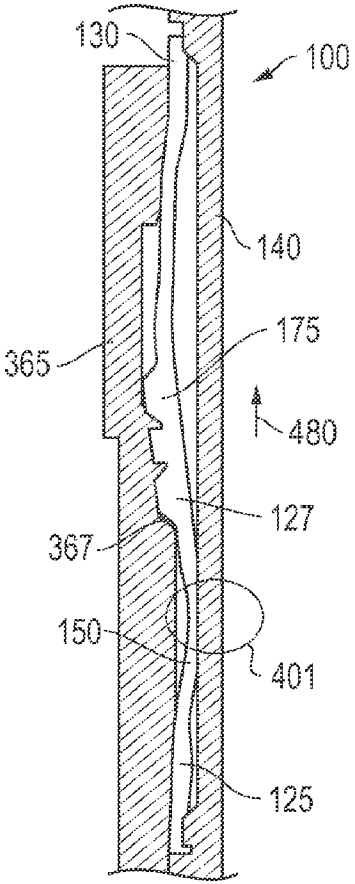

Continuing with reference to FIG. 4A, in one embodiment, a load of between about 10,000 lbs. and about 25,000 lbs. is sufficient to initiate the deformation of the central region 150 as noted at 401. This deformation is responsive to the immobility of the actuator mandrel 365 as noted above. Further, the central region 150 is comparatively thinner than the adjacent portions 125, 175. The engagement portion 175 in particular includes a thicker transition 127 as well as a profile for engagement with the recess 367 of the actuator mandrel 365.

With added reference to FIGS. 4B-4D, the nature of the engagement between the matching profile of the engagement portion 175 and the recess 367 begins to change with continued upward pull (arrow 480). That is, an interface 475 at this location begins to take on an increasing angular orientation of the engagement portion 175 relative the recess 367. Similarly, the continued pull results in ever increasing but predictable plastic deformation of the comparatively thinner central region 150 as noted at 402, 403 and 404.

In one embodiment, the initial deformation at 401 is achieved by application of loads upwards of 25,000 lbs. as noted above. The continued increase in load may result in additional discrete deformations 402, 403 of FIGS. 4B and 4C at loads of between about 40,000 lbs. and about 45,000 lbs. Further, continued increase in load pull to in excess of about 100,000 lbs. may result in the deformation 404 depicted in FIG. 4D. However, such values are only exemplary and alternate collet element 130 embodiments may be tailored for different types and increments of deformation based on material choices, overall dimensions and other factors. Additionally, the imparting of such loads need not be on a sustained continuous basis. Rather, as described further below, cycles of load, perhaps of lower values, may be utilized in attaining the depicted deformation.

Continuing with reference to FIGS. 4A-4D and with added reference to FIG. 1, the compressive accordion-like responsiveness of the noted deforming region 150 is repeated for each element 130 of the shifting tool 100. Thus, from a radial perspective, the tool 100 may be set to take on a slightly reduced overall diameter (D') relative its profiled engagement portions 175 (see FIG. 5B). By the same token, however, the engagement portions 175 may remain locked into engagement with the recess 367 and associated tooth-like features. Therefore, an initial larger overall diameter (D) may persist.

Figure 5A:
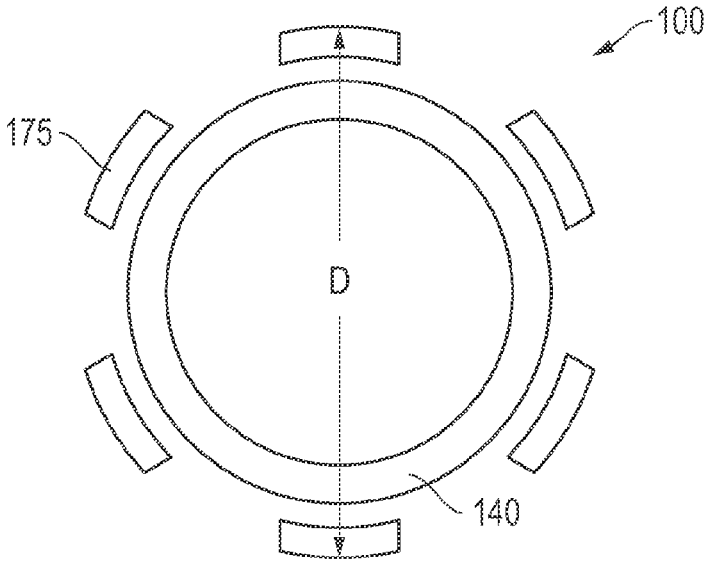
FIG. 5A is a front sectional view of an embodiment of the shifting tool and initial diameter prior to the emergency disengagement sequence of FIGS. 4A-4D.
Figure 5B:
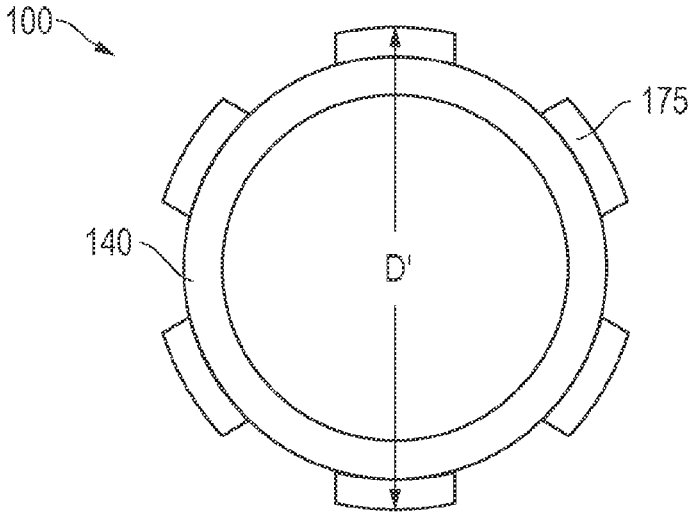
FIG. 5B is a front sectional view of the tool of FIG. 5A with a reduced diameter following the emergency disengagement sequence of FIGS. 4A-4D.

With added reference to FIGS. 5A and 5B, a reduction a diameter reduction for the tool 100 may be achieved following the controlled deformation as noted above. Namely, the work string, including the tool 100 and each support mandrel 140 and element 130 thereof may be shifted in a downhole direction (see arrow 490). This may be directed through conventional surface equipment 275 as depicted in FIG. 2. Thus, a release of the engagement portion 175 from the recess 367 may be achieved, at which time, the overall diameter of the tool 100 may naturally reduce (from D to D'). Once more, as described further below, this alternating of upward (arrow 480) and downward (arrow 490) motion may be employed without allowing for release but rather as an alternate technique for enhanced control over the deformation.

Figure 6:
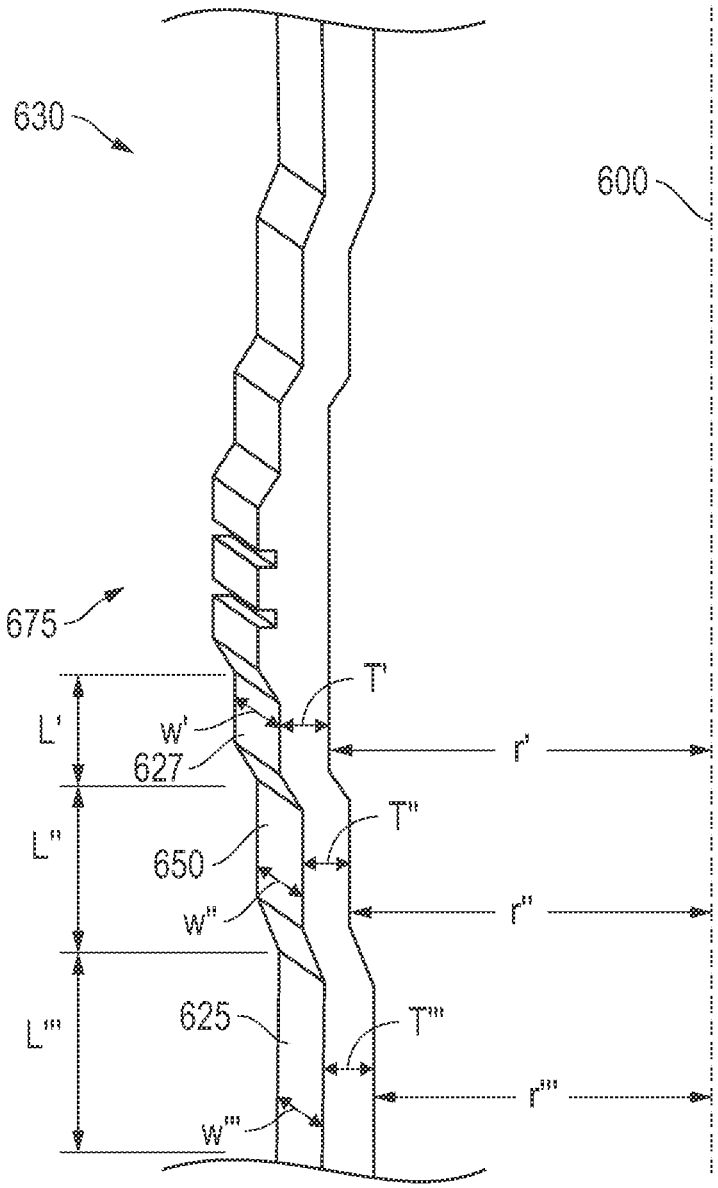
FIG. 6 is a perspective view of an alternate embodiment of a single collet element of the tool.

Referring now to FIG. 6, a perspective view of another embodiment of collet element 630 is depicted. Similar to the element 130 of FIG. 1, the element 630 of FIG. 6 is equipped with an engagement portion 675 for interfacing downhole features as described hereinabove. Further, the central region 650 may again be of a lesser thickness (T") as compared to the thicknesses (T"', T') of the adjacent portion 625 and location 627. However, in addition to such thickness variations, the element 630 may be configured with a host of other dimensional characteristics tailored for control over deformation as detailed above.

Continuing with reference to FIG. 6, additional dimensional characteristic variations are apparent. For example, the element 630 may be of lesser width (w") at the central region 650 as compared to widths (w"', w') at the adjacent portion 625 and location 627. Similarly, the length (L") may differ substantially from that of the adjacent portion 625 (see L"') and location 627 (see L'). Further, with reference to a central axis 600 of the overall tool 100, the radius (r"', r", r') may vary relative different positions (625, 650, 627). More specifically, in the embodiment shown, the central region 650 is located at a position reflecting a radius (r") that is between the radiuses (r"', r') of the portion 625 and the location 627. In some embodiments, the particular radiuses (r', r", r"'), widths (w', w", w"'), lengths (L', L", L"') and thicknesses (T', T", T"') may all be a matter of tailored design choice, with specific values selected based on loads, material choices and other variables affecting the controlled deformation.

Figure 7:
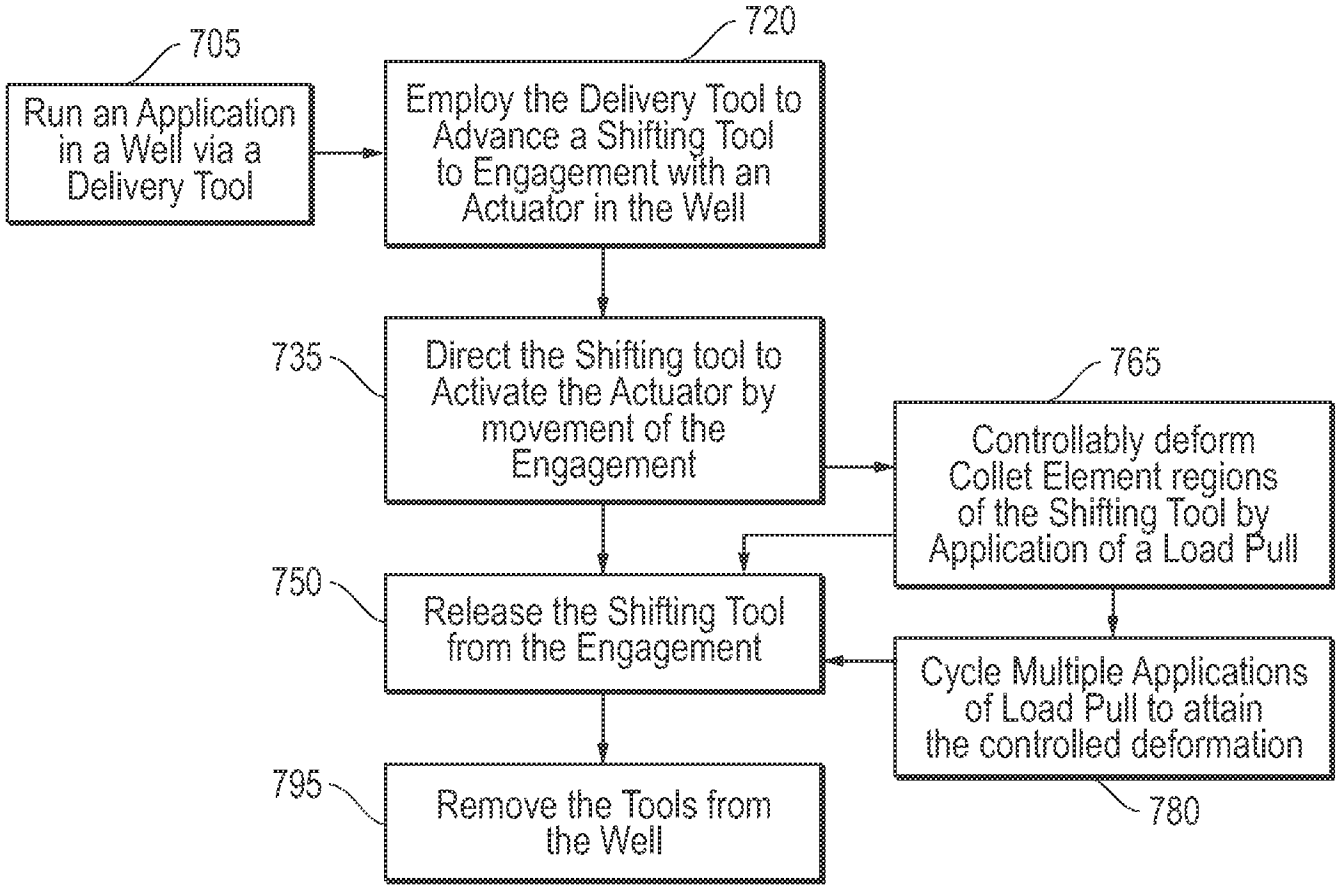
FIG. 7 is a flow-chart summarizing an embodiment of utilizing a controllably releasable shifting tool in a downhole environment.

Referring now to FIG. 7, a flow-chart summarizing an embodiment of utilizing a controllably releasable shifting tool in a downhole environment is depicted. As with embodiments described above, the shifting tool may be provided along with a delivery tool that is utilized in any of a variety of downhole applications (see 705). For example, the shifting tool may be utilized following gravel packing in a generally open-hole section of a well. Regardless, following the interventional application, the shifting tool may be brought into engagement with an actuator as indicated at 720. For embodiments depicted above, the actuator is utilized in conjunction with a formation isolation valve. Although in other embodiments, different types of valves and other devices may be triggered by an actuator as described herein.

Once in place, the shilling tool may be utilized for activating the actuator as indicated at 735. So, in the example of the valve noted above, the valve may be closed by such activation. However, in circumstances where the activation fails due to a stuck actuator arm or mandrel, collet element regions of the shifting tool may be controllably deformed as noted at 765. This is achieved through the use of comparatively thin central regions of each collet element. Thus, unpredictable collet breakage and/or unduly low load pull tolerances (e.g. below about 10,000 lbs.) may be avoided. In fact, even in circumstances where load pull is sought to remain below a given amount, say about 50,000 lbs., multiple cycles of load pull may be utilized as indicated at 780. As such, the controlled deformation may be achieved without application of a continuous pull of substantially greater amounts.

Regardless, with either the actuator shifted or the controlled collapse achieved, the shifting tool may be released from engagement as indicated at 750. Thus, as noted at 795, the delivery and shifting tools may be safely removed from the well.

Embodiments described hereinabove include tools and techniques for allowing emergency release of a shifting tool in a controlled and reliable manner. Once more, the controlled release is reliable enough that release need not be set at a load of less than 10,000 lbs. In fact, application of load pull in excess of 50,000 to 100,000 lbs. or more may be safely utilized without undue concern over shifting tool breakage in a downhole location. As a result, stuck actuator arms may be more frequently dislodged or unstuck with the shifting tool already in place. Thus, downhole operations may proceed in a more streamlined fashion with less frequent need for separate interventions to address stuck actuator arms.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

We claim:

1. A shifting tool comprising at least one collet element for engagement with an actuator and disengagement therefrom in a substantially actuator damage-free manner, said collet element comprising:

an engagement portion for the engagement with the actuator;

a base portion for coupling to a delivery tool; and a distinct central region coupled to said portions and of a dimensional characteristic substantially differing from that of said portions to allow for a predictable plastic deformation directed thereat to govern the disengagement upon exposure to a given load, the engagement and base portions of substantially greater resistance to such deformation than the central region.

2. The shifting tool of claim 1 further comprising a support mandrel of the tool to accommodate the element and translate the given load thereto.

3. The shifting tool of claim 2 wherein the given load is in excess of about 25,000 lbs.

4. The shifting tool of claim 1 wherein said engagement portion comprises a keyed profile for the engagement with the actuator and a transition location for consistency in the thickness.

5. The shifting tool of claim 1 wherein the dimensional characteristic is one of thickness, length, width and radial distance from a central axis of the tool.

6. The shifting tool of claim 5 wherein the thickness of said portions is between about 145 and about 185 thousands of an inch and that of said central region is between about 75 and about 125 thousands of an inch.

7. A downhole assembly for disposal in a well at an oilfield, the assembly comprising:

a substantially permanent downhole device;

an actuator coupled to said device for triggering thereof; and a shifting tool for activating engagement with said actuator via an engagement portion of a collet thereof and having a distinct non-engaging controllably plastically deformable central region of the collet for governing disengagement in a substantially actuator damage-free manner upon load-based failure of the activating, the engagement portion of substantially greater resistance to such deformation than the central element.

8. The assembly of claim 7 further comprising a delivery tool for coupling to said shifting tool for deployment thereof from a surface of the oilfield adjacent the well.

9. The assembly of claim 8 wherein the delivery tool is a gravel packing tool with a wash pipe to accommodate the coupling.

10. The assembly of claim 7 wherein said device is selected from a group consisting of a valve, a sliding sleeve, and a packer.

11. The assembly of claim 10 wherein the valve is selected from a group consisting of a formation isolation valve and a ball valve.

12. A method comprising:

deploying a shifting tool to a downhole location in a well;

engaging an actuator at the location with an engagement portion of a collet element of the tool; and imparting a load pull on a distinct controllably plastically deformable central region of the element of the engaged tool for translation to the actuator with retained structural soundness of the element, the engagement portion of substantially greater resistance to such deformation than the central region.

13. The method of claim 12 wherein said imparting further comprises one of:

activating the actuator; and releasing the tool from the engagement in a substantially damage-free fashion via deformation of the central region of the element.

14. The method of claim 13 wherein said releasing comprises:

deforming the central region of the element by said imparting of the load pull;

advancing the tool in a downhole direction for disengagement from the actuator; and removing the tool from the well.

15. The method of claim 14 wherein the load pull is in excess of 100,000 lbs.

16. The method of claim 14 wherein said deforming comprises repeatably imparting the load pull, the load being below about 50,000 lbs.

17. The method of claim 14 wherein an engagement portion of the tool decreases in diameter upon the disengagement.

18. The method of claim 12 further comprising performing an application in the well with an application tool coupled to the shifting tool after said deploying.

19. The method of claim 18 wherein the application is a gravel packing application.

20. The method of claim 19 wherein the actuator is coupled to a formation isolation valve.

* * * * *